United States Patent [19]

Garvin

[11] Patent Number: 5,016,844

[45] Date of Patent: May 21, 1991

[54] OPEN TOP TRASH BAG HOLDER

[76] Inventor: William D. Garvin, 2115 NW. 12th, Apt. 1, Oklahoma City, Okla. 73112

[21] Appl. No.: 609,313

[22] Filed: Nov. 5, 1990

[51] Int. Cl.[5] ..... A63B 55/04

[52] U.S. Cl. ..... 248/97; 248/150

[58] Field of Search ..... 248/95, 97, 99, 100, 248/101, 150; 220/401, 403, 404; 141/390, 316; 53/390; 16/DIG. 13

[56] References Cited

U.S. PATENT DOCUMENTS

| | | | |
|---|---|---|---|
| Re. 26,606 | 6/1969 | Dodge | 248/97 X |
| 765,388 | 7/1904 | Lanpher | 248/97 |
| 3,768,763 | 10/1973 | Hembree | 248/97 |
| 3,893,648 | 7/1975 | Gilbert | 248/97 |
| 4,273,167 | 6/1981 | Stillwell | 248/97 X |
| 4,376,520 | 3/1983 | Wetherington | 248/150 X |
| 4,509,570 | 8/1985 | Eby | 141/390 |
| 4,537,376 | 8/1985 | Buku | 248/101 X |
| 4,562,983 | 1/1986 | Klefbeck | 248/95 X |
| 4,684,087 | 8/1987 | Spickard | 248/150 X |
| 4,845,809 | 7/1989 | Pillifant | 16/DIG. 13 X |
| 4,889,300 | 12/1989 | Gibson | 248/97 |
| 4,891,862 | 1/1990 | Holan | 16/DIG. 13 X |
| 4,921,193 | 5/1990 | Benesch | 248/99 X |
| 4,921,196 | 5/1990 | Rudko | 220/404 |
| 4,957,252 | 9/1990 | Watkins | 248/100 X |

FOREIGN PATENT DOCUMENTS

| | | | |
|---|---|---|---|
| 2177996 | 2/1987 | United Kingdom | 248/97 |

*Primary Examiner*—J. Franklin Foss

*Attorney, Agent, or Firm*—Robert K. Rhea

[57] ABSTRACT

An open top trash bag holder is formed by a rectangular frame dimensioned to closely receive the open end of a draw string equipped trash bag when doubled back upon itself over the perimeter of the frame. A plurality of legs vertically depending from the frame and respectively spaced inward from the respective end portions of the frame define an overhanging lip which prevents gravitational removal of the trash bag open end portion from the frame by the mass of waste material placed within the bag.

2 Claims, 1 Drawing Sheet

OPEN TOP TRASH BAG HOLDER

BACKGROUND OF THE INVENTION

1. Field of the Invention

This invention relates to bag supporting structures and more particularly to a partially disassembled and manually assembled trash bag holder for supporting a pliable bag in open position.

The use of open top pliable bags, particularly plastic bags, has come into general use for disposing of waste material such as leaves, grass, clippings and garbage which are bagged and the bag top closed by a tie for disposal of the bag and its contents.

The principal disadvantage in the use of such bags or placing waste material therein is that it is difficult for one person to hold the bag top in an open position and place the waste material therein. This invention provides a demountable holder for holding a plastic bag in a top open position.

2. Description of the Prior Art

The prior art generally discloses a number of devices for holding flexible bags, such as plastic bags, in top open position by a leg supported frame in which the top portion of the bag is surrounded by the frame.

Some prior patents of this type provide pins on the frame to which the bag is hooked over but have the difficulty of the pins tearing the bag. This is particularly true if the frame and its supporting legs holds the bag in an elevated position with respect to its bottom spaced above the surface of the earth and resulting in the mass of waste material in the bag pulling or tearing the top portion of the bag from its support.

The most pertinent prior patent is believed to be U.S. Pat. No. 3,768,763 which discloses a rectangular frame which surrounds the top open end of a plastic bag and in which the bag is turned over the perimeter of the frame for holding it in place. The frame being supported above the surface of the earth by a pair of legs mounted on horizontal bases. This device also includes a lid for closing the bag prior to the time of its being tied for disposal.

This invention is distinctive over this and other prior patents by providing a rectangular frame having right angular corners and opposing end portions overhanging the position of its supporting legs over which the top end of a draw string-type open top bag may be placed and in which the draw string maintains the bag in open frame engaged position and prevents the mass of material placed therein from pulling the bag top off the frame.

The frame legs are manually removable from the frame for storage of the holder when not in use. A manually removable hinged top opens and closes the bag during the time it is being filled with trash before disposal.

SUMMARY OF THE INVENTION

An endless rectangular frame having right angular corners and a perimeter dimension snugly receiving the top open end of a draw string closed plastic bag when placed therein with the top edge portion of the bag doubled back upon itself in a U-shape over the perimeter of the frame.

The frame is formed from plastic pipe and fittings with elbows defining the respective corners thereof. A tee fitting having its threaded bull-head opening facing downwardly is interposed in the respective longitudinal side member of the frame near the respective corner elbow.

A like plurality of legs depend from the respective tee and are threadedly connected with its opening. The length of the legs is substantially equal to the overall depth or height of the bag when supported by the frame so that the mass of material placed therein is principally supported by the surface of the earth.

A lid overlies the frame and bag therein and is removably hingedly connected with one longitudinal side of the frame.

The principal object of this invention is to provide a partially manually knockdown trash bag top holding frame having a lid for receiving trash or garbage for disposal with the bag.

DESCRIPTION OF THE PREFERRED EMBODIMENTS

Figure 1:
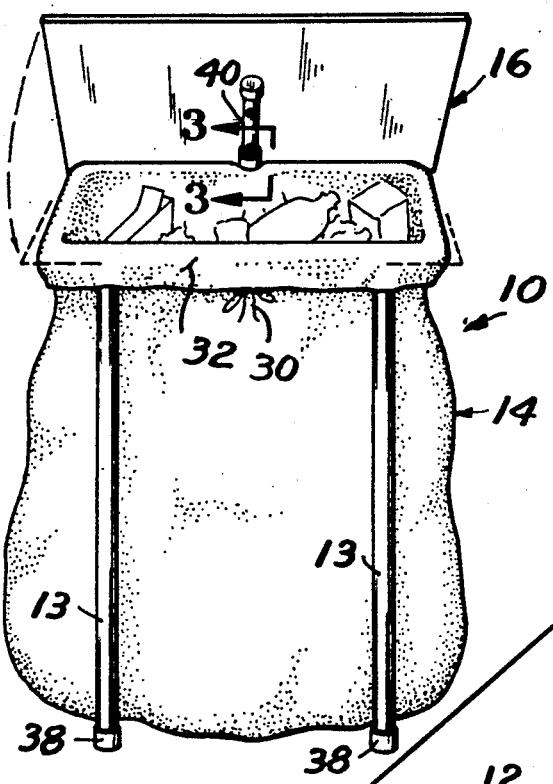
FIG. 1 is a perspective view of the bag holder in lid raised position.
Figure 3:
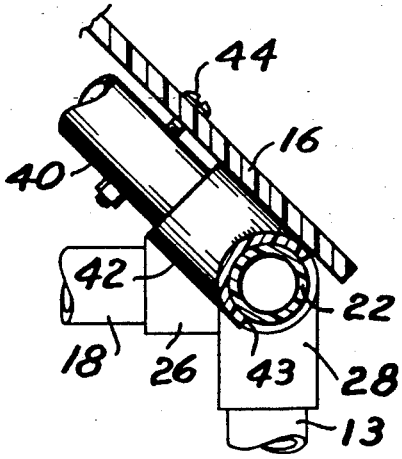

Like characters of reference designate like parts in those figures, of the drawings in which they occur.

In the drawings:

The reference numeral 10 indicates the device comprising an open rectangular normally horizontal frame 12 supported by legs 13 and supporting a draw string-type plastic bag 14 and having a frame supported hingedly connected lid 16 for temporarily closing the open top of the bag.

The frame 12 is formed from conventional tubular plastic piping and fittings joined in conventional slip joint relation as will now be explained.

Selected lengths of the piping form opposing frame end rails 18–20 and side rails 22–24. The respective end of the end rails 18 and 20 is connected with an elbow 26.

A like plurality (four) tee fittings 28 are respectively connected with the ends of the side rails 22 and 24 and in turn connected with the respective elbow 26 with the threaded bullhead opening of the respective tee facing downward and spaced longitudinally of the frame from the axis of the respective end rail for the purpose presently explained. The completed frame lies in a common plane.

The plastic bag 14 is preferably of the type provided with a draw string 30 at its open end.

The perimeter of the frame 12 is dimensioned so that the open end edge portion of the bag is snugly received by the frame perimeter when the bag is inserted into the frame and its top edge portion 32 is doubled back upon itself in inverted U-shaped fashion over the perimeter of the frame so that the respective frame end rail 18 and 20 projecting beyond a vertical plane defined by the respective adjacent pair of legs 13 forms a transverse frame shoulder, or horizontal ledge over which the draw string equipped down turned frame end portion of the expanded bag top is held against removal from the frame by the mass of garbage or trash placed within the bag and expanding the walls thereof.

Additionally, the draw string may be tightened while the bag is frame supported, if needed as by tieing, as illustrated by FIG. 1.

A like plurality of the legs 13 (four in the example shown) respectively depend vertically from a respective tee 28 and are threadedly connected therewith at their upper ends by a male threaded fitting 34.

Figure 2:
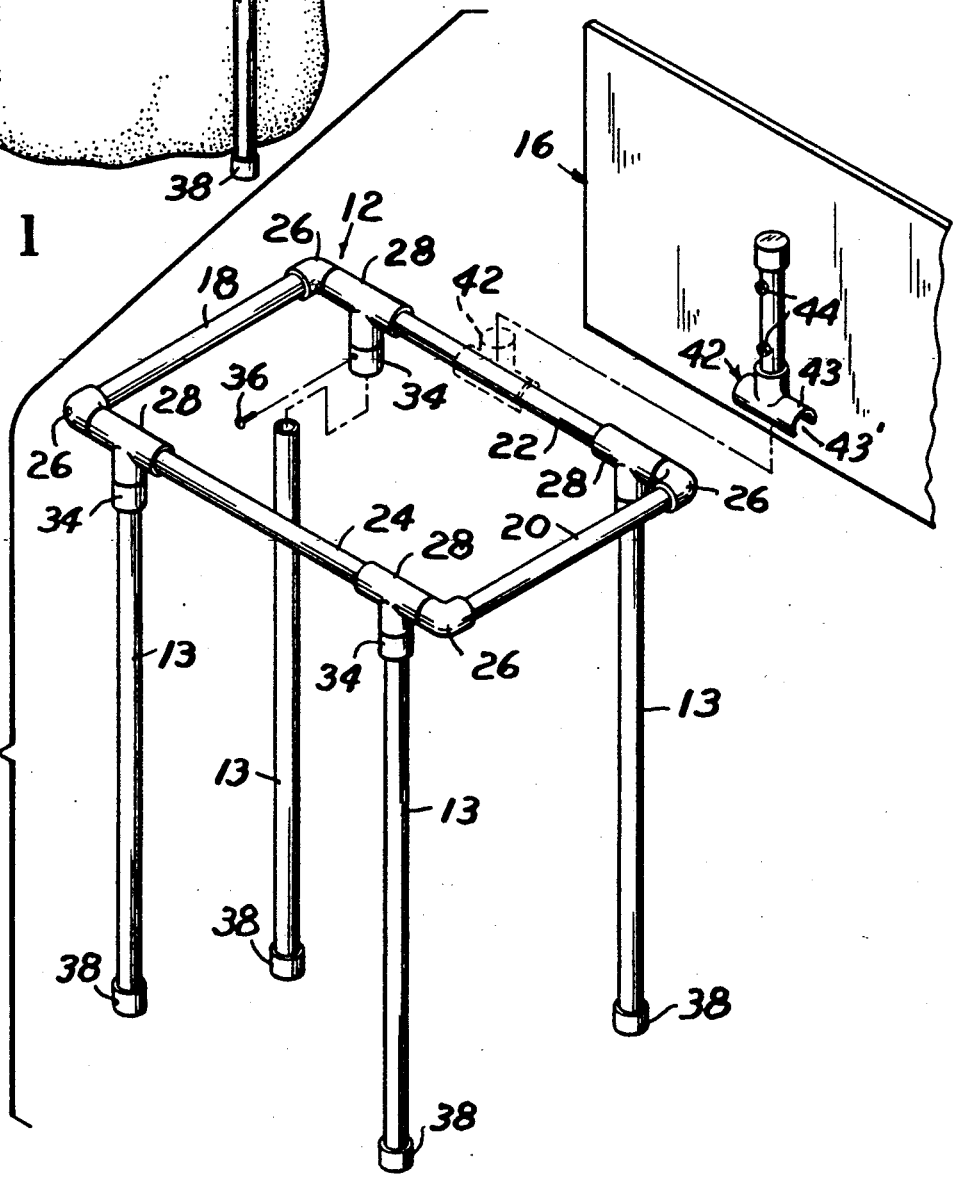
FIG. 2 is an exploded perspective view of the bag holding frame and a fragmentary portion of the lid; and, FIG. 3 is a vertical cross sectional view to a larger scale taken substantially along the line 3—3 of FIG. 1.

Obviously, the several fittings (elbows, tees, etc.) may be connected with the respective end portion of the pipe members by threaded screws, or the like, as illustrated at 36 (FIG. 2).

The depending end portion of the respective leg 13 is covered by a cap 38.

The lid 16 is preferably formed from light weight planar relatively thin material having overall dimensions overlying the open top of the bag 14 when placed within the frame, as illustrated by dotted lines (FIG. 1).

The lid 16 is connected with one of the frame rails by a length of pipe 40 connected at one end with the bullhead opening of a tee 42 and anchored to the lid as by bolts and nuts 44.

The tee 42 has a circumferential portion of its running wall portion or bar 43 longitudinally removed opposite its bullhead opening, as at 43' in an arc of approximately 150° so that the remaining approximately 210° arc wall portion of the tee bar may be manually forced over an intermediate longitudinal portion of the circumference of the frame side rail 22. This permits the tee 42 and lid 16 to be manually pivoted as a unit about the axis of the frame side rail 22 in a lid opening and closing action.

OPERATION

In operation, the device is normally partially disassembled by removing the legs 13 from the frame for temporary or permanent storage.

The device is erected by manually threadedly engaging the legs 13 with the respective tees 28 and manually forcing the lid hinge tee 42 over one of the side rails 22 or 24 of the frame.

A plastic bag, such as the bag 14, is then inserted into the confines of the frame 12 and its top edge portion 32 is doubled back upon itself outwardly over the perimeter of the frame so that the draw string 30 under slight tension defines a dimension less than the outside perimeter dimension of the frame 12 and maintains the bag in open position within the frame. The lid 16 then may be pivoted to temporarily close the bag.

When the bag becomes full, it is manually removed from the frame after removing the bag top portion 32 and manually pulling the draw string 30 and tieing the top of the bag 14, by lifting the frame upwardly off the bag.

Obviously the invention is susceptible to changes or alterations without defeating its practicability. Therefore, I do not wish to be confined to the preferred embodiment shown in the drawings and described herein.

I claim:

1. In a knockdown manually assembled without hand tools holder for a normally open top draw string closed bag of predetermined size and generally rectangular transverse cross section formed from pliable plastic sheet material, the improvement comprising:

an endless rectangular normally horizontal rigid frame of a predetermined perimeter dimension for removably supporting said bag top with the draw string portion of the bag top disposed outwardly, said frame being formed from parallel tubular end rails and side rails respectively joined in slip joint fashion by tubular elbows for defining right angular corners of the frame;

a tubular tee interposed in slip joint fashion in the respective side rail adjacent the respective elbow, each said tee having an internally threaded bullhead opening with its axis disposed vertically downward normal to the axis of the respective side rail and normal to the plane of the frame;

a tubular leg depending from the threadedly engaged at its upper end portion with the respective said tee bullhead opening;

a lid overlying said frame for temporarily closing the bag open top; and, hinge means removably connecting said lid with one said frame side rail, said hinge means comprising a tubular tee-shaped member having the bar portion of the tee-shape defined by a transversely arcuate wall encompassing a transverse arc of at least 200° for frictionally gripping a companion arc of the periphery of said one frame side rail intermediate its ends.

2. In a knockdown manually assembled without hand tools holder for a normally open top draw string closed bag of predetermined size and generally rectangular transverse cross section formed from pliable plastic sheet material, the improvement comprising:

rectangular endless normally horizontal rigid frame means having predetermined perimeter dimensions for removably supporting said bag top with the draw string portion of the bag top disposed outwardly;

said frame being formed from parallel tubular end rails and side rails, said side rails joined in slip joint fashion with a tubular tee at the respective end thereof;

a tubular elbow at the respective end of said end rails and joined in slip joint fashion with the respective said tee for defining right angular corners of the frame, each said tee having a bullhead opening disposed downwardly normal to the axis of the respective side rail and normal to the plane of the frame;

two pairs of tubular legs for supporting said frame and having a length no greater than the vertical dimension of the bag when supported by said frame, each leg of said pair of legs respectively depending vertically from and engaged at its upper end portion with the respective said tee bullhead opening, whereby the respective end portion of said frame projects longitudinally beyond a vertical plane defined by the axes of the respective adjacent pair of legs;

a lid overlying said frame for temporarily closing the bag open top;

hing means removably connecting said lid with oen said frame side rail, said hinge means comprising a tubular tee-shaped member having the bar portion of the tee-shape defined by a transversely arcuate wall encompassing a transverse arc of at least 200° for frictionally gripping a companion arc of the periphery of said one frame side rail intermediate its ends.

* * * * *